United States Patent [19]

Guinan

[11] Patent Number: 4,665,284

[45] Date of Patent: May 12, 1987

[54] MECHANISM FOR TRANSMITTING MOVEMENT BETWEEN SWITCH HANDLES OF RESPECTIVE SWITCHES

[75] Inventor: Thomas Guinan, Trenton, N.J.

[73] Assignee: Heinemann Electric Company, Lawrenceville, N.J.

[21] Appl. No.: 822,871

[22] Filed: Jan. 27, 1986

[51] Int. Cl.[4] ..... H01N 9/26

[52] U.S. Cl. ..... 200/50 C

[58] Field of Search ..... 200/5 R, 5 B, 5 E, 50 C, 200/DIG. 6; 74/483 R; 361/350, 351, 353

[56] References Cited

U.S. PATENT DOCUMENTS

| | | | |
|---|---|---|---|
| Re. 26,113 | 11/1966 | Carter et al. | 200/50 C |
| 1,053,245 | 2/1913 | Turner et al. | 200/50 C X |
| 2,348,107 | 5/1944 | Brongersma | 200/50 C X |
| 2,557,351 | 6/1951 | Jacobson | 200/50 C X |
| 3,086,090 | 4/1963 | Carroll | 200/5 E |
| 3,492,448 | 1/1970 | Phillips, Jr. | 200/50 C |
| 3,501,603 | 3/1970 | Willcox | 200/5 E X |
| 3,674,948 | 7/1972 | Betlejewski et al. | 200/50 C |
| 3,767,872 | 10/1973 | Whitchurch | 200/50 C |
| 4,539,860 | 9/1985 | Johnstone et al. | 200/50 C X |

*Primary Examiner*—J. R. Scott

*Attorney, Agent, or Firm*—Dann, Dorfman, Herrell and Skillman

[57] ABSTRACT

A mechanism for transmitting movement between switch handles of respective switches permits the actuation of a switch from one conductive state to another conductive state when an adjacent switch unit is actuated from a first conductive state to a second conductive state. Each of the switch units include respective switch handles which are movable between first and second stable positions to actuate the respective switch units between first and second conductive states. A rotatable rocking crank includes a pair of crank arms which project in divergent directions from the axis of rotation to respective positions immediately proximate to and on the same side of the respective switch handles so that rotational movement of the crank is limited in one rotational direction by one of the switch handles and in the other rotational direction by the other switch handle. The crank arms are oriented so that movement of one switch handle from its first position to its second position rotates the crank to drive the other switch handle from its second position back to its first position.

24 Claims, 5 Drawing Figures

MECHANISM FOR TRANSMITTING MOVEMENT BETWEEN SWITCH HANDLES OF RESPECTIVE SWITCHES

FIELD OF THE INVENTION

The present invention relates to a mechanism for transmitting movement between switch handles of respective switches, and more particularly, to a mechanism for switching a switch unit from one conductive state to another conductive state when an adjacent switch unit is switched from a first conductive to a second conductive state.

BACKGROUND OF THE INVENTION

In certain applications, it is desirable for separate electrical circuits or even separate groups of electrical circuits to be arranged so that if one group of circuits is switched to a conductive state, another group of circuits is switched to a non-conductive state in alternating fashion. For example, separate loads may be alternately connected and disconnected with either a common power source or separate power sources. In other arrangements, it may be desirable to alternately switch a common load between separate power sources so that as one power source is disconnected from the load the second power source is simultaneously connected to prevent any interruption of power to the load. So that the desired pattern of alternate switching may be effected essentially simultaneously, a need has been recognized for a coupling mechanism which operates to switch one group of circuits off as the other group of circuits is switched on.

Applications in which separate circuits or separate groups of circuits are protected by circuit breakers coupled for alternate switching, it is desirable that all of the separate groups of circuits have the capability to be switched to non-conductive states during the same time period. Proper safety precaution mandates that the capability exist for the separate circuit breakers to be turned off at the same time to permit, for example, a common load which is alternately connected with separate power sources to be safely serviced or repaired. Consequently, in applications where a selected pattern of alternate switching of separate groups of circuits is desired for circuits protected by separate circuit breakers, it is desirable for a coupling mechanism to have the capability of permitting either circuit breaker to switch off without affecting the conductive state of the other circuit breaker.

In accordance with the present invention, a mechanism is provided which automatically turns one circuit breaker off when an adjacent circuit breaker is turned on. The mechanism in accordance with the present invention assures that the main contacts of both circuit breakers cannot be closed at the same time. The mechanism of the present invention does permit, however, both of the circuit breakers to be switched off at the same time.

SUMMARY OF THE PRESENT INVENTION

In accordance with the present invention, a mechanism is provided for switching a switch means from one conductive state to another conductive state when an adjacent switch means is switched from a first conductive state to a second conductive state. The mechanism assures that whenever one switch means is switched on, the other switch means is switched off.

The mechanism in accordance with the present invention includes support means and first and second switch means. Each switch means includes a respective switch actuator arm movable between a first stable position and a second stable position to actuate the respective switch means between first and second conductive states. The first and second switch means are supported in fixed position relative to one another on the support means and are oriented so that the respective actuator arms move along generally similar adjacent paths.

A rocking crank is rotatably supported relative to the support means. The rocking crank has an axis of rotation and a pair of crank arms which project in divergent directions from the axis of rotation. The crank arms project to respective positions immediately proximate to and on the same general side of the respective actuator arms so that the rotational movement of the crank is limited by the respective actuator arms. More specifically, the rotational movement of the crank is limited in one rotational direction by one of the actuator arms and is limited in the other rotational direction by the other actuator arm. The crank arms are oriented so that the movement of each actuator arm from the first position to the second position moves the crank to drive the other actuator arm from the second position to the first position. The arrangement of the crank arms also enables each actuator arm to remain in its first position when the other actuator arm is switched from its second position back to its first position.

BRIEF DESCRIPTION OF THE DRAWINGS

The foregoing summary, as well as the following detailed description of the preferred embodiment of the present invention, will be better understood when read in conjunction with the accompanying drawings, in which.

DETAILED DESCRIPTION OF THE PREFERRED EMBODIMENT

Figure 1:
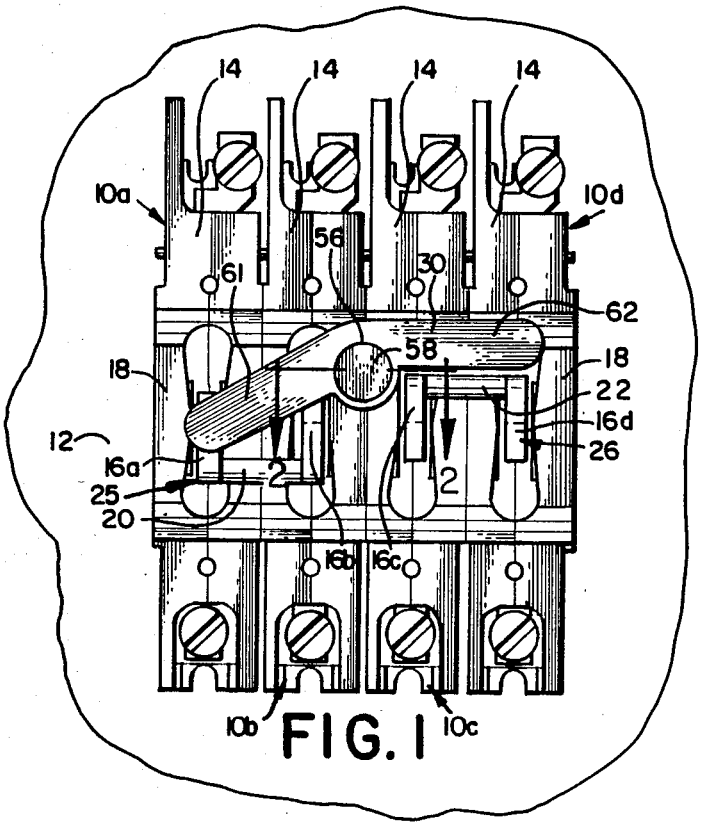
FIG. 1 is a front elevational view of a mechanism for transmitting movement between switch handles of respective switch units in accordance with the present invention.

Referring to the figures, and particularly to FIG. 1, a series of individual switching units, such as circuit breakers, generally designated 10*a*, 10*b*, 10*c* and 10*d*, are mounted on a panel 12 in side-by-side arrangement. The circuit breakers 10*a*, 10*b*, 10*c* and 10*d* are held and supported in fixed position relative to one another by suitable support structure such as panel 12. The operating mechanism of each circuit breaker is housed within an outer protective casing 14. Switch levers 16*a*, 16*b*, 16*c* and 16*d* project from the front portion 18 of the casing 14 of each of the respective circuit breaker units 10*a*, 10*b*, 10*c* and 10*d*, respectively. The switch levers 16*a*, 16*b*, 16*c* and 16*d* enable actuation of the respective circuit breaker units between first and second conductive states.

Each switch lever is rotatably movable between a first stable position, as occupied by switch levers 16*a* and 16*b* in FIG. 1, when the respective circuit breaker units are in the off state with the internal breaker contacts open, and a second stable position, as occupied by switch levers 16*c* and 16*d* in FIG. 1, when the respective circuit breaker units are in the on state with the internal breaker contacts closed. Of course, in other arrangements, one or more switching units may be oriented so that whenever a switch lever is in a first stable position as occupied for example by switch levers 16*a* and 16*b* in FIG. 1, the switch unit is in the on state so that the internal contacts of the switch are closed. The orientation of the switch units depends on the desired switching pattern to be achieved. Of course, when the switch units are circuit breakers, precaution should be taken to assure that all the breakers can turn off or trip off at the same time.

As illustrated in FIG. 1, a tie rod 20 couples switch levers 16*a* and 16*b* together so that the switch levers move together as a switch handle unit generally designated 25, and serve as a common actuator arm for the coupled circuit breakers 10*a* and 10*b*. Likewise, tie rod 22 couples switch levers 16*c* and 16*d* together so that the switch levers move together as a switch handle unit generally designated 26, and serve as a common actuator arm for coupled circuit breakers 10*c* and 10*d*. It is also desirable for the coupled circuit breaker units, such as breaker units 10*a* and 10*b*, to share an internal trip lever so that the conductive states of the circuit breaker units, can be simultaneously switched. When coupled together by the tie rods and internal trip levers, the individual interconnected circuit breaker units, such as breakers 10*a* and 10*b*, form a multi-pole switch.

The circuit breaker units 10*a*, 10*b*, 10*c* and 10*d* are supported by panel 12 in fixed position so that the switch handles 25 and 26, as well as the separate switch levers 16*a*, 16*b*, 16*c* and 16*d*, are rotatable about a generally common axis of rotation and along generally uniform parallel paths of movement between respective first positions as occupied for example by switch levers 16*a* and 16*b* in FIG. 1 and respective second positions, as occupied by switch levers 16*c* and 16*d* in FIG. 1. The respective paths of movement of the switch handles 25 and 26 are generally adjacent to one another. As illustrated in FIG. 1, the respective first positions for the switch handles 25 and 26 are oriented generally adjacent to one another and likewise the respective second positions of switch handles 25 and 26 are also oriented generally adjacent to one another. Whenever the switch handle units 25 and 26 occupy the same position, the switch handle units are oriented so that the switch levers of both switch handle units, or common points on the levers, lie in the same plane.

Figure 2:
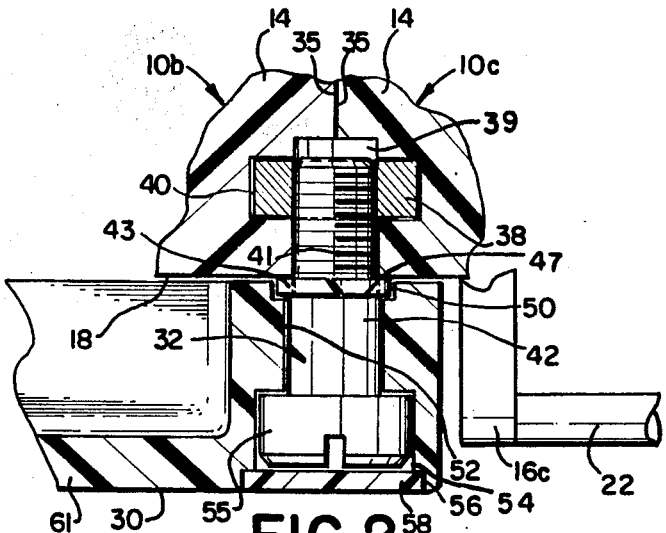
FIG. 2 is a fragmentary sectional view of the mechanism taken along line 2—2 of FIG. 1.

To transmit movement between the switch handles 25 and 26, a rocking crank 30 is rotatably supported at the front portions 18 of the casings 14 of the circuit breaker units 10*b* and 10*c* generally between the paths of movement of the respective switch handles 25 and 26. The mounting structure for rotatably securing the crank 30 to the circuit breaker units is best shown in FIG. 2. Referring to FIG. 2, the rocking crank is rotatably held in position by a shoulder screw 32 which serves as a shaft for the crank 30. The screw 32 has a threaded end 41 and an unthreaded shank portion 42 which adjoin one another. The shank portion 42 has a greater cross-sectional diameter than the threaded end 41 so that a shoulder 47 is provided adjacent the threaded end 41. The screw has a head 55 which adjoins the shank portion 42 distal to shoulder 47. The screw 32 is held in place by a nut 38 anchored in conforming internal cavities in adjacently engaging and adjoining sidewalls 35 of the casings 14 of adjacent brakes 10*b* and 10*c*. Access to internal cavities 40 is provided by an unthreaded generally cylindrical bore 39 which provides an opening dimensioned to receive the threaded end 41 of the screw 32. In order to anchor the retaining nut 38 in position to hold the screw 32 in place, the conforming cavities 40 in each of the sidewalls 35 of the adjoining circuit breaker units 10*b* and 10*c* are at predetermined positions so that the cavities 40 are oriented in registry with one another. A lock washer 43 of a diameter to fit the threaded end 41 of screw 32 is held between the shoulder 47 of the screw 32 and the front surface 18 of the circuit breaker casings 14. The washer 43 is compressed as the screw 32 is threaded into the retaining nut 38 to securely hold the screw 32 in position supporting crank 30 in place on the shank portion 42 and the head 55 of the screw protruding from the front portion 18 of the casings 14.

To permit rotatable mounting of the rocking crank 30 on the projecting shank 42 and head 55 of the screw 32, the crank 30 is counter bored from both sides to provide a passageway through the crank having adjoining generally cylindrically shaped bore portions of different cross-sectional diameters. As illustrated in FIG. 2, a generally cylindrical disc shaped counter bore portion 50 is positioned proximate the front portion 18 of the casing 14 and is dimensioned to enclose lock washer 40 in loose fit with sufficient tolerance in the axial direction and sufficient clearance in the cross-sectional direction to permit rotation of the crank about the lock washer 40. A generally cylindrically shaped bore portion 52 having a cross sectional diameter which is smaller than the cross sectional diameter of bore portion 50 adjoins bore portion 50 and is dimensioned to surround the shank portion 42 of the screw in loose fit with sufficient tolerance in the axial direction and sufficient clearance in the cross-sectional direction to permit rotation of the crank 30 thereon. A generally cylindrically shaped counter bore portion 54 having a cross sectional diameter greater than bore portion 52 adjoins bore portion 52 and is dimensioned to receive the head 55 of the screw 32 so that the head 55 of the screw retains the crank 30 in position at the front portions 18 of the casings 14. A further generally disc shaped or cylindrically shaped counter bore portion 56 adjoins bore portion 54 and has a cross sectional diameter greater than bore portion 54. A generally disc-shaped closure cap 58 is dimensioned to fit within the bore portion 56 in snug fit to enclose the head 55 of the screw 32. The closure cap 58 enhances the aesthetic appearance of the mechanism and prevents dirt and dust from entering the bore.

As illustrated in FIG. 1, the crank 30 is mounted on the screw 32 so that the axis of rotation of the crank 30 is common with the longitudinal axis of the screw 32. The axis rotation of the crank 30 is oriented at a generally right angle relative to the axis of rotation of switch handles 25 and 26. The crank 30 in the illustrated embodiment includes a pair of crank arms 61 and 62 projecting in divergent directions from the axis of rotation to respective positions immediately proximate to and on the same side of the respective switch handles 25 and 26 so that rotational movement of the crank 30 is limited in one rotational direction by switch handle 25 and is limited in the other rotational direction by switch handle 26. Specifically referring to FIG. 1, the counter-clockwise rotation of the crank 30 is limited by switch handle 25 when the switch handle 25 is in its first position as illustrated in FIG. 1. Similarly, the clockwise rotation of the crank 30 is limited by switch handle 26 when switch handle 26 is switched into its first position as shown schematically in FIG. 3B. Accordingly, the crank moves along an arcuate path between stopped positions provided by the respective switch handles 25 and 26.

The crank arms 61 and 62 are preferably oriented generally perpendicular with respect to the axis of rotation of the crank 30 and lie in a generally common plane. The crank arms 61 and 62 diverge from the axis of rotation at generally obtuse angle relative to one another. Crank arm 61 projects from the axis of rotation through the path of movement of switch handle 25 to the side of the switch handle 25 proximate the second position of such switch handle. Crank arm 62 projects from the axis of rotation through the path of movement of switch handle 26 on the side of the switch handle 26 proximate the second position of that switch handle.

Figure 3A:
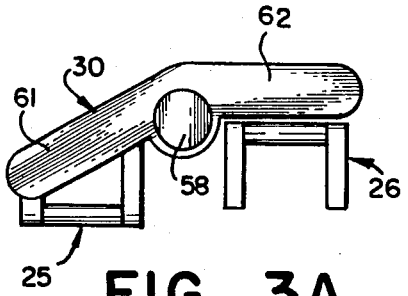
FIGS. 3A–3C are schematic views showing the cooperation between the switch handles of respective switch units and a rocking crank which couples and transmits the movement between the switch handles.
Figure 3B:
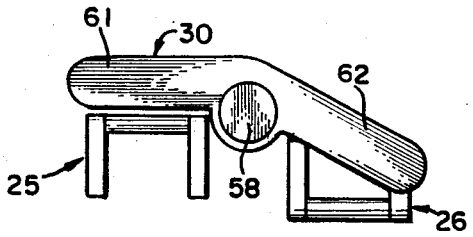
Figure 3C:
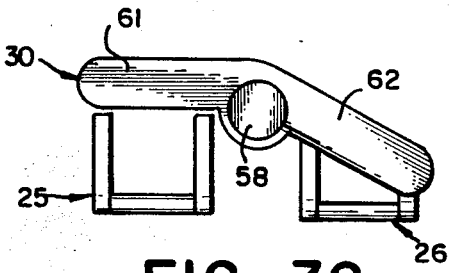

The cooperation between the crank 30 and the switch handles 25 and 26 is best shown in FIGS. 3A–3C. Referring to FIG. 3A, switch handle 25 is oriented in its first position which, for example, corresponds to the respective circuit breaker unit being off with the internal contacts open. Switch handle 26 is in its second position which, for example, corresponds to the on position of the respective circuit breaker in which the internal contacts of the breaker are closed. As switch handle 25 is switched from the first position to the second position, switch handle 25 engages crank arm 61 causing the crank 30 to rotate so that crank arm 62 engages switch handle 26 and drives the switch handle 26 from its second position to its first position as illustrated in FIG. 3B. Rotation of the crank 30 is permitted until switch handle 25 reaches its second position where further movement of the crank 30 is stopped by switch hand1e 26 oriented in its first position. To restore the switch handles to the positions illustrated in FIG. 3A, switch handle 26 may be manually moved back from its first position to its second position, causing the rotation of the crank 30 so that crank arm 61 drives switch handle 25 from its second position back to its first position as illustrated in FIG. 3A. The crank 30 transmits movement between the switch handles 25 and 26 so that the movement of either switch handle from its first position to its second position causes the other switch handle to move from its second position back to its first position.

In order to enable a load or loads to be disconnected from all sources of power at the same time it is desirable for all of the coupled circuit breaker units to have the capability of being switched off at the same time. As illustrated in FIG. 3B, when switch handle 25 is in its second position and switch handle 26 is in its first position, switch handle 25 may be switched back to its first position as illustrated in FIG. 3C. Since the switch handles are not attached to crank arms 61 and 62, the crank 30 will not move when switch handle 25 is switched back to its first position and, consequently, switch handle 26 will also remain in its first position as illustrated in FIG. 3C. When the first position of each switch handle corresponds to the off condition of each of the respective breakers, both of the breakers will be switched off at the same time.

It will be recognized by those skilled in the art that changes and modifications may be made without departing from the broad inventive concepts of the present invention. It is understood, therefore, that the present invention is not limited to the particular embodiment illustrated and described herein, but is intended to cover all changes and modifications within the scope and spirit of the invention as set forth in the appended claims.

What is claimed is:

1. A mechanism for enabling switching of a switch means from one conductive state to another conductive state when another switch means is switched from a first conductive state to a second conductive state, comprising:

(a) first and second switch means, each switch means having a respective switch actuator arm moveable between a first stable position and a second stable position to actuate the respective switch means between first and second conductive states, the first and second switch means being supported relative to one another so that the respective actuator arms move along generally similar adjacent paths, each switch means having a separate casing positionable in side-by-side arrangement with the other casing and each casing having a front wall portion with a respective one of the actuator arms protruding therefrom and a sidewall portion shaped to engage an adjacent sidewall portion of the other casing when the casings are positioned in the side-by-side arrangement, the sidewall portion of each casing having a cavity portion positionable in registry with the cavity portion of the adjoining sidewall portion of the other casing to form an internal cavity and at least one sidewall portion providing an opening extending from the internal cavity to the front wall portions of the casings;

(b) shaft means having a longitudinal axis supported relative to the switch means, said shaft means including an anchoring nut captured within said internal cavity and a screw having a threaded end extending through said opening into said internal cavity for threaded engagement with the nut, a shank portion protruding from the front wall portions of the casings, and a head portion adjoining the shank portion; and (c) a rocking crank rotatably supported and mounted on the shank portion of the screw, the head portion of the screw having a dimension sufficient to retain the crank on the shank portion of the screw, the crank having an axis of rotation generally common with the longitudinal axis of the shaft means and a pair of crank arms projecting in divergent directions from the axis of rotation to respective positions immediately proximate to the respective actuator arms so that rotational movement of the crank is limited by movement of the actuator arms, the crank arms being oriented so that movement of each actuator arm from the first position to the second position enables movement of the crank to drive the other actuator arm from the second position to the first position.

2. The mechanism in accordance with claim 1 wherein the crank arms project from the axis of rotation to positions on the same general side of the actuator arms so that rotational movement of the crank is limited in one rotational direction by one of the actuator arms and in the other rotational direction by the other actuator arm.

3. The mechanism in accordance with claim 2 wherein the arms of the crank are each oriented generally perpendicular with respect to the axis of rotation and lie along a generally common plane.

4. The mechanism in accordance with claim 3 wherein the arms of the crank project from the axis of rotation at a generally obtuse angle relative to one another.

5. The mechanism in accordance with claim 1 wherein each switch means includes a pair of separate switching units and each actuator arm includes:

first and second generally rotatable switch levers for actuating the separate switching units; and coupling means for coupling the switch levers together to enable simultaneous movement of the switch levers.

6. The mechanism in accordance with claim 1 wherein the crank includes a passageway therethrough, the passageway having a first generally cylindrically shaped portion of a first diameter dimensioned to receive the shank portion of the screw in loose fit to permit rotation of the crank thereon, a second generally cylindrically shaped portion adjoining said first portion distal to the front wall portions of the casings having a diameter greater than the first portion dimensioned to receive the head portion of the screw in loose fit.

7. The mechanism in accordance with claim 6 wherein said passageway through the crank includes a third generally cylindrically shaped portion adjoining the second portion distal to the front wall portions of the casings having a diameter greater than the second portion, and said mechanism includes a generally disc-shaped cap dimensioned to removably fit within the third portion of the passageway in snug fit to enclose the head portion of the screw within the passageway.

8. The mechanism in accordance with claim 7 wherein the shank portion of the screw protruding from the casings has a cross-sectional diameter greater than the threaded end to provide a shoulder proximate the threaded end, and the shaft means includes a lock washer for said screw dimensioned to be held between the shoulder of the screw and the front wall portions of the casings to cooperate with said nut to hold the screw in position and wherein said passageway through the crank includes a fourth generally cylindrically shaped portion adjoining the first portion proximate the front wall portion of the casings having a diameter greater than the diameter of the first portion for receiving the lock washer in loose fit.

9. The mechanism in accordance with claim 1 wherein the arms of the crank are dimensioned to project from the rotational axis so that the respective arms of the crank lie within the respective paths of movement of the actuator arms during movement of each respective actuator arm from its first position to its second position so that the crank may be continuously rotated as each respective actuator arm moves from the first position to the second position.

10. The mechanism of claim 1 in which the switch means are supported in the side-by-side arrangement with the switch actuator arms being arranged along generally parallel planes.

11. The mechanism of claim 1 in which at least one of said switch means includes a plurality of switching units coupled together to be simultaneously actuated by movement of the rocking crank.

12. The mechanism in accordance with claim 1 wherein the first conductive state of each of the switch means is off and the second conductive state of each of the switch means is on.

13. The mechanism in accordance with claim 1 wherein each of said switch arms comprises a switch handle.

14. A mechanism for coupling movement between switch handles of respective switch means comprising:

(a) at least a pair of switch means held together in side-by-side arrangement, one switch means having a first protruding switch handle and the other switch means having a second protruding switch handle, the switch means being oriented so that the switch handles are separately rotatable about a generally common axis of rotation and along generally uniform parallel paths of movement between respective first positions oriented generally adjacent to one another and respective second positions oriented generally adjacent to one another, each switch means having a separate casing positionable in side-by-side arrangement with the other casing and each casing having a front wall portion with a respective one of the switch handles protruding therefrom and a sidewall portion shaped to engage an adjacent sidewall portion of the other casing when the casings are positioned in the side-by-side arrangement, the sidewall portion of each casing having a cavity portion positionable in registry with the cavity portion of the adjoining sidewall portion of the other casing to from an internal cavity and at leat one sidewall portion providing an opening extending from the internal cavity to the front wall portions of the casings;

(b) shaft means having a longitudinal axis supported relative to the switch means, said shaft means including an anchoring nut captured within said internal cavity and a screw having a threaded end extending through said opening into said internal cavity for threaded engagement with the nut, a shank portion protruding from the front wall portions of the casings, and a head portion adjoining the shank portion; and (c) a rocking crank rotatably supported and mounted on the shank portion of the screw having an axis of rotation generally common with the longitudinal axis of the shaft means, the crank having a first arm projecting from the axis of rotation in position to pass through the path of movement of the first switch handle on a side of the first switch handle proximate the second position of the first switch handle, and a second arm projecting from the axis of rotation in position to pass through the path of movement of the second switch handle on a side of the second switch handle proximate the second position of the second switch handle, the arms of the crank diverging from the axis or rotation to respective positions so that movement of a respective one of the switch handles from the first position to the second position with the other switch handle disposed in its second position rotates the crank to move the other switch handle from its second position to its first position, and so that movement of a respective one of the switch handles from the second position to the first position with the other handle oriented in its first position enables the other switch handle to stay in its first position.

15. The mechanism in accordance with claim 14 wherein the first and second arms of the crank are each oriented generally perpendicular with respect to the axis of rotation and lie along a generally common plane.

16. The mechanism in accordance with claim 15 wherein the first and second arms of the crank project from the axis of rotation at a generally obtuse angle relative to one another.

17. The mechanism in accordance with claim 14 wherein each switch means includes a pair of separate switching units and each switch handle includes:

first and second generally rotatably switch levers for actuating the separate switching units; and coupling means for coupling the switch levers together to enable simultaneous movement of the switch levers.

18. The mechanism in accordance with claim 14 wherein the crank includes a passageway therethrough, the passageway having a first generally cylindrically shaped portion of a first diameter dimensioned to receive the shank portion of the screw in loose fit to permit rotation of the crank thereon, a second generally cylindrically shaped portion adjoining said first portion distal to the front wall portions of the casing having a diameter greater than the first portion dimensioned to receive the head portion of the screw in loose fit.

19. The mechanism in accordance with claim 18 wherein said passageway through the crank includes a third generally cylindrically shaped portion adjoining the second portion distal to the front wall portions of the casings having a diameter greater than the second portion, and said mechanism includes a generally disc-shaped cap dimensioned to removably fit within the third portion of the passageway in snug fit to enclose the head portion of the screw within the passageway.

20. The mechanism in accordance with claim 19 wherein the shank portion of the screw protruding from the casing has a cross-sectional diameter greater than the threaded end to Provide a shoulder proximate the threaded end, and the shaft means includes a lock washer for said screw dimensioned to be held between the shoulder of the screw and the front wall portion of the casings to cooperate with said nut to hold the screw in position and wherein said passageway through the crank includes a fourth generally cylindrically shaped portion adjoining the first portion proximate the front wall portion of the casings having a diameter greater than the diameter of the first portion for receiving the lock washer in loose fit.

21. The mechanism in accordance with claim 14 wherein the first and second arms of the crank are dimensioned to project from the rotational axis so that the respective arms of the crank lie within the respective paths of movement of the switch handles during movement of each respective switch handle from its first position to its second position so that the crank may be continuously rotated as each respective switch handle moves from the first position to the second position.

22. The mechanism of claim 14 in which the switch means are supported in the side-by-side arrangement with the switch handles being arranged along generally parallel planes.

23. The mechanism of claim 14 in which at least one of said switch means includes a plurality of separate switching units coupled together to be simultaneously actuated by movement of the rocking crank.

24. The mechanism in accordance with claim 14 wherein the first conductive state of each of the switch means is off and the second conductive state of each of the switch means is on.

* * * * *